United States Patent [19]

Heinrich et al.

[11] Patent Number: 4,731,886

[45] Date of Patent: Mar. 22, 1988

[54] ROTATING POST ACTIVATOR FOR SWINGING VEHICLE DOOR

[75] Inventors: Siegfried Heinrich, Edermünde-Besse; Manfred Horn, Kaufungen, both of Fed. Rep. of Germany

[73] Assignee: Gebr. Bode & Co. GmbH, Kassel, Fed. Rep. of Germany

[21] Appl. No.: 905,810

[22] Filed: Sep. 10, 1986

[30] Foreign Application Priority Data

Sep. 12, 1985 [DE] Fed. Rep. of Germany ..... 3532514

[51] Int. Cl.[4] ..... F16H 21/44; E05F 11/54; E05F 15/04

[52] U.S. Cl. ..... 49/334; 49/335; 74/99 R; 92/151

[58] Field of Search ..... 74/99 R, 99 A; 49/334, 49/335, 337; 92/151

[56] References Cited

U.S. PATENT DOCUMENTS

| | | | |
|---|---|---|---|
| 2,308,057 | 1/1943 | Cooley | 49/334 |
| 2,338,965 | 1/1944 | Parsons | 49/334 |
| 2,983,256 | 5/1961 | Seeloff | 92/151 X |
| 3,313,215 | 4/1967 | Bieri | 92/151 X |
| 4,296,677 | 10/1981 | Little et al. | 92/151 X |
| 4,490,941 | 1/1985 | Mamach | 49/334 X |

FOREIGN PATENT DOCUMENTS

| | | | |
|---|---|---|---|
| 1961573 | 7/1971 | Fed. Rep. of Germany | 49/334 |
| 2073815 | 10/1981 | United Kingdom | 49/335 |

*Primary Examiner*—Allan D. Herrmann
*Attorney, Agent, or Firm*—Sprung Horn Kramer & Woods

[57] ABSTRACT

A device for activating a rotating post, especially one that moves a swinging-door panel in a motor vehicle and which need no additional space at each end of the rotating post. The post is rotatably mounted in a mount at each end. The post is a hollow cylinder that accommodates a worm gear driven by a bi-directional pneumatic piston-and-cylinder drive. The piston-and-cylinder drive is completely accommodated inside the post and consists of at least two piston-and-cylinder units pneumatically connected in parallel with a common piston rod. Each unit incorporates a piston and cylinder aligned within a sleeve that is rigidly fastened to and coaxial with one of the mounts. The pressure medium that drives the panel in one direction is supplied to each cylinder through a coaxial bore in the piston rod. The bore extends axially and connects all the pistons. The bore communicates with the insides of the cylinders in the vicinity of each piston face that faces the same direction. The pressure medium that drives the panel in the other direction is supplied through a supply channel with an essentially annular cross-section positioned between the outside surface of the cylinders and the inside surface of the sleeve. The supply channel communicates with the insides of the cylinders in the vicinity of each cylinder face opposite the piston faces that face the other direction.

4 Claims, 3 Drawing Figures

ROTATING POST ACTIVATOR FOR SWINGING VEHICLE DOOR

BACKGROUND OF THE INVENTION

The present invention relates to a device for activating a rotating post, especially one that moves a swinging-door panel in a motor vehicle, whereby the post, which is mounted in such a way that it can rotate in mounts at each end, is a hollow cylinder that accommodates a worm gear driven by a bi-directional pneumatic piston-and-cylinder drive with a piston rod that is attached to part of the worm gear and is positioned in such a way that it cannot rotate within a guide that is rigidly fastened to one of the mounts.

An activating device of this type is known for example from German Pat. No. 1 961 573. The piston-and-cylinder drive is located outside of and at one end of the rotating post and is connected to it by means of a worm gear inside the post.

The drawback of the known activating device is that it requires space above and below the rotating post to accommodate the piston-and-cylinder drive although the space at each end of the post is limited, especially in motor vehicles, such as buses for example.

SUMMARY OF THE INVENTION

The object of the present invention is to provide an activating device of the aforesaid type that demands no additional space at each end of the rotating post.

This object is attained in accordance with the invention by an improvement wherein the piston-and-cylinder drive is completely accommodated inside the hollow-cylinder rotating post and consists of at least two piston-and-cylinder units, pneumatically connected in parallel, each incorporating a piston and cylinder aligned within a sleeve that is rigidly fastened to and is coaxial with one of the mounts, wherein the axial guide is rigidly fastened to the end of the sleeve facing the worm gear, which consists of a drive spindle and of a bearing cylinder, wherein the pressure medium that drives the panel in one direction is supplied to each cylinder subsequent to an initial cylinder through a coaxial bore in the piston rod, which extends axially and connects all the pistons, with the bore communicating with the insides of the cylinders in the vicinity of each piston face that faces the same direction, and wherein the pressure medium that drives the panel in the other direction is supplied through a supply channel with an essentially annular cross-section that is positioned between the outside surface of the cylinders and the inside surface of the sleeve and that communicates with the insides of the cylinders in the vicinity of each cylinder face opposite the pistion faces that face the other direction.

Thus, the piston-and-cylinder drive in the activating device in accordance with the invention is completely inside the rotating post. Since the post cannot exceed a prescribed thickness, the first problem to be solved is to ensure that the piston-and-cylinder drive will have a large enough piston face. This problem is solved by aligning two or more pneumatically parallel piston-and-cylinder units inside the post. Another problem is to ensure that the torque generated at the point where the piston-and-cylinder drive is connected to the worm gear will be accommodated at that point to prevent the piston rod from rotating along with the post. In the known activating device this problem is solved by accommodating the piston rod in such a way that it cannot rotate in a guide that is rigidly connected to one of the mounts. With the known mount, this design is not very expensive because the piston-and-cylinder drive is outside the rotating post, so that the guide can be located in the immediate vicinity of the mount.

With the activating device in accordance with the invention it was necessary to shift the guide between the piston-and-cylinder drive and the worm gear fairly far into the rotating post, positioning it at the middle or even above the middle of the post in relation to the mount that accepts the torque, especially when more than two piston-and-cylinder units are aligned together. This problem was solved by accommodating the piston-and-cylinder units inside a sleeve that is connected to the mount at the end of post that accommodates the piston-and-cylinder drive in such a way that the sleeve cannot rotate in relation to the mount.

Since the piston-and-cylinder units are intended to be subjected to pressure medium in both directions, two separate medium-supply channels must be introduced into the relatively small space. Thus, the medium can be supplied either through a coaxial bore in the piston rod or through an annular channel between the cylinders and the sleeve.

The available space is accordingly optimally exploited.

The device for activating a rotating post in accordance with the invention is simple in design, requires very little space, and generates enough torque to rotate the post at a relatively low medium pressure while accepting the opposing torque with great simplicity and efficiency.

The device for activating a rotating post in accordance with the invention is particularly easy to assemble. The piston-and-cylinder drive can be assembled from units mounted together and inserted into the sleeve from one end, specifically.

(a) the cylinders, which have an outer diameter that is a prescribed distance shorter than the inside diameter of the sleeve, (b) partitions, which are positioned between the cylinders, which the cylinders fit over, which have an outside diameter that equals over at least part of their length the inside diameter of the sleeve, and which have a coaxial bore for a piston rod to extend through and either at least one longitudinal groove around their outer edge or at least one access opening toward one of their faces, and (c) the piston rod, which extends axially, which is sealed off by the partitions, which has pistons mounted on it at prescribed points, and which has the axial bore and at least one access in the vicinity of the pistons and communicating with an outlet in each piston face.

Tubular spacers can be slid over the piston rod and rest against the facing piston faces of the aligned pistons, with the annular access gaps between the spacers and the piston rod and between the spacers and the partitions sealed off with gaskets.

The end of the piston rod facing the worm gear can be rigidly fastened to the guide, which has teeth that extend axially and engage matching teeth on a counterpart rigidly fastened to the sleeve, and which is rigidly fastened to the drive spindle of the worm gear.

Although the device for activating a rotating post in accordance with the invention is primarily intended for swinging doors on motor vehicles, buses or even rail vehicles for example, it can also be employed for baggage-compartment doors or flaps of the type employed on tour buses for example, in which case the post will be horizontal.

A preferred embodiment of the invention will now be described with reference to the attached drawings, wherein

DETAILED DESCRIPTION OF THE PREFERRED EMBODIMENTS

Figure 1:
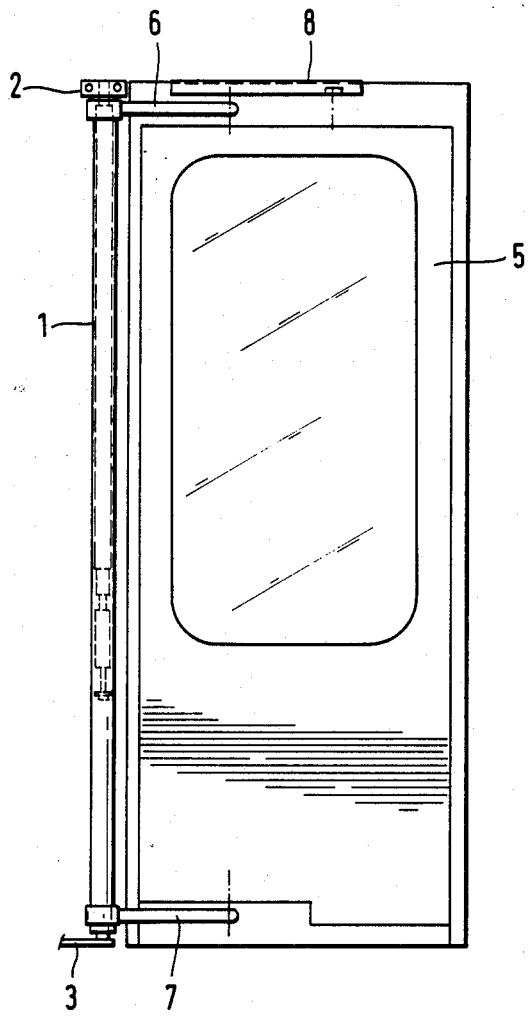
FIG. 1 is a front view of a swinging-door panel employed with an activating device in accordance with the invention.
Figure 2:
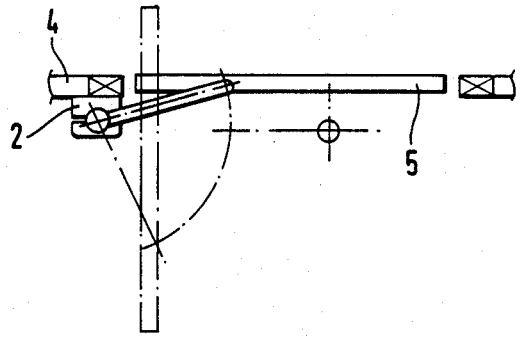
FIG. 2 is a top view of the panel illustrated in FIG. 1.

With reference now to FIGS. 1 and 2, the panel 5 of a swinging door is mounted in a known way on pivoting arms 6 and 7 on a rotating post 1 that rotates in mounts 2 and 3 in the door frame or on the body 4 of an otherwise unillustrated bus. Panel 5 is also positioned in a known way in relation to the door frame or body by a schematically illustrated guide 8.

The solid lines in FIG. 2 illustrate the panel in the closed position and the dot-and-dash lines in the open position. The panel swings through an angle of about 90°.

Figure 3:
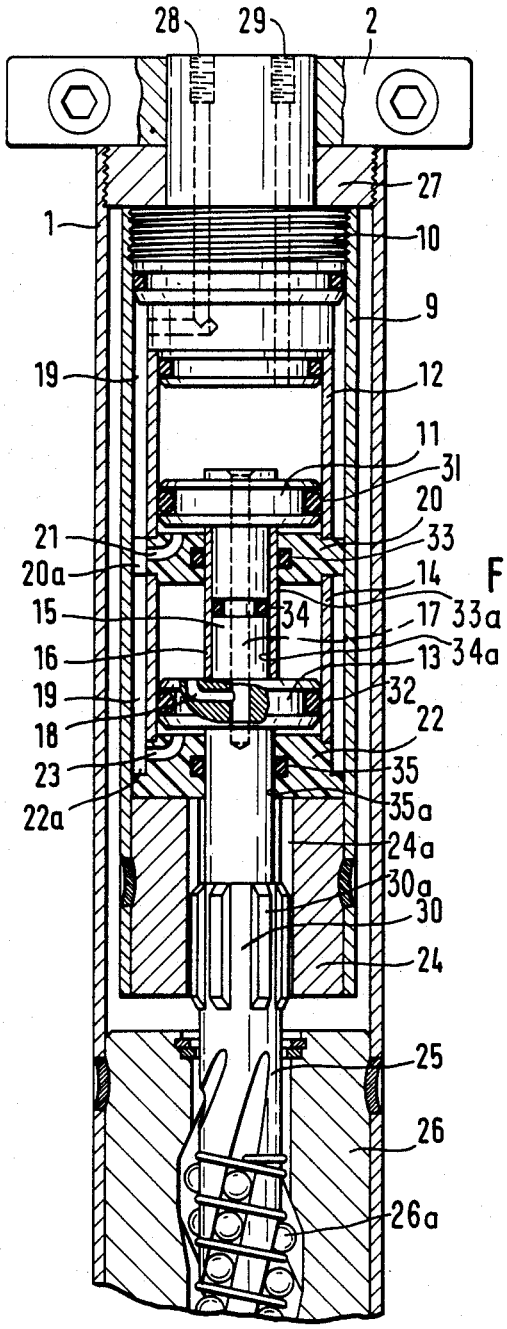
FIG. 3 is a larger scale partial vertical section through the post illustrated in FIG. 1, wherein the horizontal dimensions are exaggerated to improve legibility.

FIG. 3 illustrates the device for activating the rotating post in greater detail as completely integrated into the post.

Rotating post 1, which is in the form of a hollow cylinder, is attached to mount 2, which is rigidly fastened to the body of the vehicle, by means of a pivot bearing 27. Also rigidly fastened to mount 2 by means of a connector 10 is a sleeve 9 that extends coaxially along part of rotating post 1. A piston-and-cylinder drive, consisting in the illustrated embodiment of two piston-and-cylinder units, each incorporating a piston 11 and cylinder 12 and a piston 13 and cylinder 14, is accommodated inside sleeve 9. Naturally, one or more additional piston-and-cylinder units could also be accommodated in the sleeve in the same way.

The piston-and-cylinder units consist of a cylinder 12 that fits tightly over the inner end of connector 10, of a partition 20 that fits over the other end of cylinder 12, and of another cylinder 14 that fits over the other end of partition 20 with its front closed off by another partition 22. The two spaces accordingly created inside the cylinders accommodate pistons 11 and 13, which are connected by a common piston rod 15 that extends tight through coaxial bores in partitions 20 and 22. The end of the piston rod that is illustrated at the bottom of FIG. 3 and that faces toward a worm gear, consisting of drive spindle 25 and bearing cylinder 26, is rigidly fastened to a guide 30. The guide has teeth 30*a* that extend axially and engage corresponding teeth 24*a* on a counterpart 24 that is secured in such a way that it cannot rotate at the bottom of sleeve 9. Guide 30 is in turn ridigly fastened to drive spindle 25 that is part of the worm gear.

The worm gear will not be specified herein. It can be of the type specified in German Pat. No. 1 961 573. Drive spindle 25 can for example can have helical grooves that accommodate balls mounted in a bearing cylinder 26 rigidly fastened to rotating post 1.

How compressed air for driving the panel in each direction is supplied to the piston-and-cylinder units will now be described.

In the connector 10 to mount 2 are two supply-and-removal channels 28 and 29. Channel 29 empties directly into the inside of cylinder 12. Piston rod 15 has an axial bore 17, one end of which opens into the inside of cylinder 12 and the other end of which extends into piston 13 and communicates with the inside of cylinder 14 through an access 18 and an outlet in the end of piston 13 that faces piston 11.

In embodiments with more than two piston-and-cylinder units. bore 17 extends farther through piston rod 15 and communicates similarly with the insides of the associated cylinders.

Channel 28 communicates with a supply channel 19 with an essentially annular cross-section between the outer surface of cylinders 12 and 14 and the inner surface of sleeve 9. In the vicinity of partition 20, which rests against the inner surface of sleeve 9, the top and bottom of supply channel 19 communicate through a longitudinal groove 20*a* in the outer surface of partition 20. When there are more than two piston-and-cylinder units, the subsequent partitions are similar in design, except that the final partition 22 has an annular recess 22*a* instead of a groove. In the vicinity of longitudinal groove 20*a* or recess 22*a*, supply channel 19 communicates with outlets through accesses 21 and 23 in the end of partitions 20 and 22 that face pistons 11 or 13. As will be evident from FIG. 3, the ends of pistons 11 and 13 that are at the top in the figure and that face mount 2 can be subjected to compressed air through channel 29, whereas the ends of pistons 11 and 13 that face worm gear 25 and 26 can be subjected to compressed air through channel 28 and supply channel 19. Thus, the pistons are pneumatically connected in parallel and the effect on the piston faces is additive.

Supplying compressed air to channel 29 causes pistons 11 and 13 to move down, and supplying compressed air to channel 28 causes them to move up.

The piston-and-cylinder drive is easy to assembly. The components are mounted together and inserted into sleeve 9 from the end facing mount 2. The bottom of piston rod 15 is secured to guide 30 by means for example of a threaded connection.

Pistons 11 and 13 can be sealed off from the inner surface of cylinders 12 and 14, by gaskets 31 and 32. The spacers 16 between pistons 11 and 13 is sealed off from partition 20 by gasket 33 on the one hand and sealed off from piston rod 15 on the other by gasket 34, the slightly thicker bottom of piston rod 15 is sealed from partition 22 by gasket 35, and cylinder 12 and sleeve 9 can be sealed off from connector 10 by means of conventional gaskets. As a result, annular access gaps 33*a*, 34*a* and 35*a* are sealed.

The mode of operation of the device will now be described. When compressed air is supplied to channel 29, it flows into the space between connector 10 and piston 11 and then through bore 17 and access 18 into the space between partition 20 and piston 13. Due to the resulting pressure, a force acts not only on piston 11 but also on piston 13, and forces both pistons down with reference to FIG. 3. Piston rod 15 and the drive spindle 25 in bearing cylinder 26 that is rigidly attached to the post 1 by guide 30 are forced down along with pistons 11 and 13. Since the teeth 30*a* on guide 30 engage the teeth 24*a* on counterpart 24, it is impossible for drive spindle 25 to rotate. As will be evident from FIG. 3, however, when drive spindle 25 is displaced by means its thread, bearing cylinder 26, which engages the thread through balls 26*a*, will be set rotating. Bearing cylinder 26 is rigidly secured to rotating post 1, which accordingly also rotates.

Rotating post 1 will rotate in the opposite direction when compressed air is supplied to channel 28. In this case the air will flow through supply channel 19 and accesses 21 and 23 on the one hand into the space between partition 20 and piston 11 or between partition 22 and piston 13, which, as will be evident from FIG. 3, will move both pistons 11 and 13 up and similarly, as described by the foregoing, through worm gear 25, 26 will rotate rotating post 1 in the opposite direction.

It will be appreciated that the instant specification and claims are set forth by way of illustration and not limitation, and that various modifications and changes may be made without departing from the spirit and scope of the present invention.

What is claimed is:

1. In a device for activating a rotating post for moving a swinging-door panel, the post comprising a hollow cylinder rotatably mounted in mounts at both ends and accommodating a worm gear driven by bi-directional pneumatic piston-and-cylinder drive means including a piston rod attached to the worm gear and positioned with a guide rigidly fastened to one of the mounts to permit only longitudinal movement of the piston rod relative to the guide, the improvement wherein the piston-and-cylinder drive means is completely accommodated inside the hollow cylindrical post and comprises a sleeve rigidly fastened to and coaxial with one of the mounts, at least two piston-and-cylinder units aligned in the sleeve and pneumatically connected in parallel, with each unit having a piston and cylinder and wherein the piston rod connects the pistons, means rigidly fastening the guide to an end of the sleeve facing the worm gear, first means receptive of a pressure medium to effect movement of the panel in one direction comprising an axial bore supplying pressure medium to one cylinder and an axial bore in the piston rod communicating with the insides of the cylinders in the vicinity of each piston face that faces the same direction, and second means receptive of a pressure medium to effect movement of the panel in the other direction comprising a supply channel with an essentially annular cross-section positioned between an outside surface of the cylinders and an inside surface of the sleeve and that communicates with the insides of the cylinders in the vicinity of each piston face opposite the piston faces of the first means.

2. The device as in claim 1, wherein the piston-and-cylinder units of the piston-and-cylinder drive means are inserted into the sleeve from one end and wherein (a) the cylinders have an outer diameter that is a prescribed distance shorter than the inside diameter of the sleeve, (b) the units comprise partitions postioned between the cylinders over which the cylinders fit and which have an outside diameter that equals over at least part of their length the inside diameter of the sleeve, and which have a coaxial bore for the piston rod to extend through and one of at least one longitudinal groove around the outer edge and at least one access opening toward one of their faces, and (c) the piston rod is sealed off by the partitions and has and at least one access in the vicinity of the pistons and communicating with an outlet in each piston face and the axial bore therein.

3. The device as in claim 2, further comprising tubular spacers slidably received over the piston rod and resting against the facing piston faces of the aligned pistons, with annular access gaps between the spacers and the piston rod and between the spacers and the partitions sealed off with gaskets.

4. The device as in claim 1, 2 or 3, wherein one end of the piston rod facing the worm gear is rigidly fastened to the guide, wherein the guide has teeth which extend axially and engage matching teeth on a counterpart rigidly fastened to the sleeve and wherein the guide is rigidly fastened to the drive spindle of the worm gear.

* * * * *